US009708102B2

(12) United States Patent
Liberman et al.

(10) Patent No.: US 9,708,102 B2
(45) Date of Patent: Jul. 18, 2017

(54) SOFT FOOD SHAPING AND STORAGE CONTAINER

(71) Applicants: Maya Barbara Liberman, Oakville (CA); Gregory Daniel Liberman, Oakville (CA)

(72) Inventors: Maya Barbara Liberman, Oakville (CA); Gregory Daniel Liberman, Oakville (CA)

( * ) Notice: Subject to any disclaimer, the term of this patent is extended or adjusted under 35 U.S.C. 154(b) by 169 days.

(21) Appl. No.: 14/804,263

(22) Filed: Jul. 20, 2015

(65) Prior Publication Data

US 2017/0021967 A1 Jan. 26, 2017

(51) Int. Cl.

| | |
|---|---|
| ***B65D 25/04*** | (2006.01) |
| ***B65D 85/72*** | (2006.01) |
| ***B65D 81/18*** | (2006.01) |
| ***B65D 43/02*** | (2006.01) |

(52) U.S. Cl.

CPC ..... *B65D 25/04* (2013.01); *B65D 43/021* (2013.01); *B65D 81/18* (2013.01); *B65D 85/72* (2013.01); *B65D 2543/0037* (2013.01); *B65D 2543/00037* (2013.01); *B65D 2543/0062* (2013.01); *B65D 2543/00101* (2013.01); *B65D 2543/00296* (2013.01); *B65D 2543/00518* (2013.01); *B65D 2543/00685* (2013.01); *B65D 2543/00796* (2013.01)

(58) Field of Classification Search

CPC .... B65D 25/04; B65D 43/0212; B65D 85/72; B65D 2543/00203; B65D 2543/00296

USPC ..... 220/507; 206/538, 540

See application file for complete search history.

(56) References Cited

U.S. PATENT DOCUMENTS

| | | | | | |
|---|---|---|---|---|---|
| 1,825,916 | A | * | 10/1931 | Mock | F25C 1/246 249/121 |
| 1,873,508 | A | * | 8/1932 | Tanger | F25C 1/246 249/121 |
| 2,125,856 | A | * | 8/1938 | De Witt | B65D 25/04 206/819 |
| 2,335,016 | A | * | 11/1943 | Lorenzen | A61J 1/03 206/538 |
| 2,367,573 | A | | 1/1945 | Gibson | |

(Continued)

OTHER PUBLICATIONS

Office Action for U.S. Appl. No. 14/158,856 dated May 27, 2015.
Office Action for U.S. Appl. No. 14/158,856 dated Sep. 27, 2014.

*Primary Examiner* — King M Chu
(74) *Attorney, Agent, or Firm* — Millman IP Inc.

(57) ABSTRACT

A container is provided. The container has a lid and a tray. The lid has a contiguous array of walls extending therefrom. The tray has a recess for receiving soft food material. The recess is sized to receive the array of walls of the lid. The tray has a contiguous array of ridges corresponding to the array of walls of the lid. A top surface of the ridges of the tray contact a bottom surface of the walls of the lid when mated to form sealed compartments. A sealing mechanism is provided along a perimeter of at least one of the lid and the tray sealing the lid and the tray along perimeters thereof, and restricting separation of the bottom surface of the walls of the lid from the top surface of the ridges of the tray when mated. At least one of the lid and the tray is formed from a flexible material so that the lid and the tray can be partially separated to remove a food portion formed in one of the compartments without breaking all of the seals of the compartments.

19 Claims, 3 Drawing Sheets

(56) References Cited

U.S. PATENT DOCUMENTS 2,587,852 A * 3/1952 Jahn ..... F25C 1/243 206/503
2,792,962 A * 5/1957 Granfelt ..... F41F 3/065 206/3
2,804,755 A * 9/1957 Ansel ..... F25C 1/24 249/121
3,061,136 A * 10/1962 Sterngart ..... A45C 11/00 220/23.8
3,933,296 A * 1/1976 Ruskin ..... B65D 1/36 206/541
3,999,661 A * 12/1976 Jones ..... B65D 81/027 206/591
4,084,695 A * 4/1978 Halbich ..... B65D 25/04 206/532
4,093,103 A * 6/1978 Mumford ..... B65D 43/162 206/1.5
4,222,547 A 9/1980 Lalonde
4,253,572 A * 3/1981 Halbich ..... B65D 83/0445 206/538
4,382,106 A 5/1983 Royster
4,412,616 A * 11/1983 Williams ..... B25H 3/022 206/703
4,432,529 A * 2/1984 McMillan ..... B65D 21/0223 249/121
4,671,405 A * 6/1987 Hagan ..... B65D 1/24 206/139
4,887,790 A * 12/1989 Wilkinson ..... A61J 3/06 206/531
4,905,957 A * 3/1990 Stockwell ..... F25C 1/24 249/108
5,027,972 A * 7/1991 Bartholomew .... B65D 81/3216 220/526
5,042,193 A * 8/1991 Steiner ..... A45C 7/0045 206/315.11
5,277,329 A * 1/1994 Pomroy ..... B65D 1/24 206/541
5,323,926 A * 6/1994 Pomroy ..... B65D 1/24 206/541
5,344,024 A * 9/1994 Cohu ..... A45C 5/03 206/526
5,397,097 A * 3/1995 Dale ..... F25C 1/243 249/120
5,858,263 A * 1/1999 Geary ..... B65D 81/383 206/575
5,915,553 A * 6/1999 Brown ..... A45C 13/02 206/372
5,950,834 A * 9/1999 Woodnorth ..... A45C 11/20 206/541
6,138,831 A * 10/2000 Agostinelli ..... B60R 7/04 206/217
6,758,338 B2 * 7/2004 Lien ..... B65D 25/10 206/534
8,596,490 B2 12/2013 Davidson et al.
8,960,467 B2 * 2/2015 Miros ..... A45C 11/20 220/23.86
9,289,083 B2 * 3/2016 Lee ..... A47G 19/30
2004/0031799 A1 * 2/2004 Dege ..... B65D 1/36 220/523
2006/0201950 A1 * 9/2006 Liu ..... B65D 1/24 220/526
2007/0107447 A1 * 5/2007 Langlotz ..... F25C 1/243 62/66
2008/0099485 A1 * 5/2008 Holbrook ..... B65D 75/245 220/507
2009/0090722 A1 * 4/2009 Ingram ..... B65D 85/672 220/507
2009/0127263 A1 * 5/2009 Hylton ..... A47G 19/2272 220/507
2009/0255936 A1 * 10/2009 Rabbit ..... B25H 3/028 220/507
2013/0175269 A1 7/2013 Chen
2013/0228580 A1 * 9/2013 Kinskey ..... B65D 25/04 220/549
2015/0102041 A1 * 4/2015 Lee ..... A47G 19/30 220/575
2015/0158632 A1 * 6/2015 Wilhelm ..... B65D 25/04 426/120
2015/0183536 A1 * 7/2015 Miros ..... A45C 11/20 53/484

* cited by examiner

SOFT FOOD SHAPING AND STORAGE CONTAINER

This application is a continuation-in-part of U.S. application Ser. No. 14/158,856 filed on Jan. 19, 2014, which in turn claims priority from U.S. Provisional Application Ser. No. 61/851,627 filed on Mar. 12, 2013, the entire contents of both which are incorporated herein by reference.

FIELD OF THE INVENTION

The present invention relates generally to the storage of food. More particularly, the invention relates to a container for storing soft food.

BACKGROUND OF THE INVENTION

Storing frozen food requires the use of a sealed container to protect food from freezer burn. Freezer burn occurs when cold, dry air reaches the food's surface, causing water vapor to sublimate out of the food product. Storing food in sealed, individual portions is ideal, but can be inconvenient, time-consuming and space-inefficient if the container does not conform exactly to the food shape.

SUMMARY OF THE INVENTION

According to an aspect of the invention, there is provided a container comprising:

- a lid having a contiguous array of walls extending therefrom; and
- a tray having a recess for receiving soft food material, the recess sized to receive the array of walls of the lid, the tray having a contiguous array of ridges corresponding to the array of walls of the lid, a top surface of the ridges of the tray contacting a bottom surface of the walls of the lid when mated to form sealed compartments; and
- a sealing mechanism along a perimeter of at least one of the lid and the tray sealing the lid and the tray along perimeters thereof, and restricting separation of the bottom surface of the walls of the lid from the top surface of the ridges of the tray when mated;
- at least one of the lid and the tray being formed from a flexible material so that the lid and the tray can be partially separated to remove a food portion formed in one of the compartments without breaking all of the seals of the compartments.

At least one or both of the walls and the ridges between the compartments can be tapered to facilitate separation of soft food material into the compartments.

Both the lid and the tray can be made of a flexible material.

The compartments can be defined by the array of walls and the array of ridges can be hexagonal.

The array of walls of the lid can fit tightly into the recess of the tray.

The walls of the lid can be sufficiently rigid to push through soft food material when the lid and the tray are being mated.

The sealing mechanism can include an overlapping lip along the perimeter of the tray for receiving and engaging the perimeter of the lid.

The tray can include a pull tab located at a corner thereof to facilitate partial separation of the tray from the lid.

According to another aspect of the invention, there is provided a container for apportioning and freezing soft food material, comprising:

- a lid having walls extending from an undersurface thereof; and
- a tray having a recess for receiving soft food material, the recess sized to snugly receive the array of walls of the lid, a bottom surface of the walls of the lid contacting the tray when mated to form sealed compartments; and
- a sealing mechanism along a perimeter of at least one of the lid and the tray sealing the lid and the tray along perimeters thereof, and restricting separation of the bottom surface of the walls of the lid from the tray when mated;
- at least one of the lid and the tray being formed from a flexible material so that the lid and the tray can be partially separated to remove a food portion formed in one of the compartments without breaking all of the seals of the compartments.

The tray can include ridges corresponding to the walls of the lid, and wherein the bottom surface of the walls of the lid contact a top surface of the ridges of the tray when the lid and tray are mated.

At least one or both of the walls and the ridges between the compartments can be tapered to facilitate separation of soft food material into the compartments.

Both the lid and the tray can be made of a flexible material.

The compartments defined by the array of walls and the array of ridges can be hexagonal.

The sealing mechanism can include an overlapping lip along the perimeter of the tray for receiving and engaging the perimeter of the lid.

DETAILED DESCRIPTION OF THE INVENTION

A container for portioning and storing soft food in accordance with an embodiment of the invention is shown in FIGS. 1 to 6. Soft foods can include, for example, ground meats, cookie dough, sauces, stews, baby food, puddings, etc.

Figure 1:
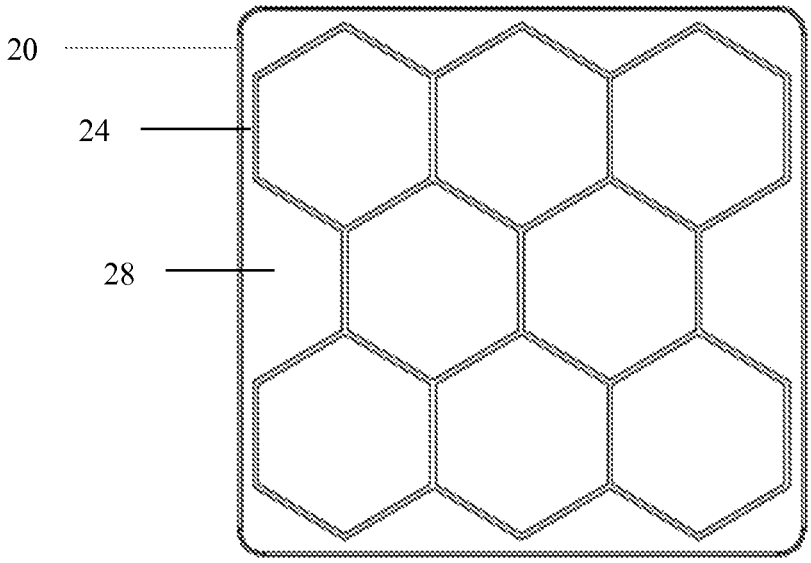
FIG. 1 is a bottom view of a lid of a food storage container in accordance with an embodiment of the invention, the lid having walls in a hexagonal arrangement.
Figure 3:
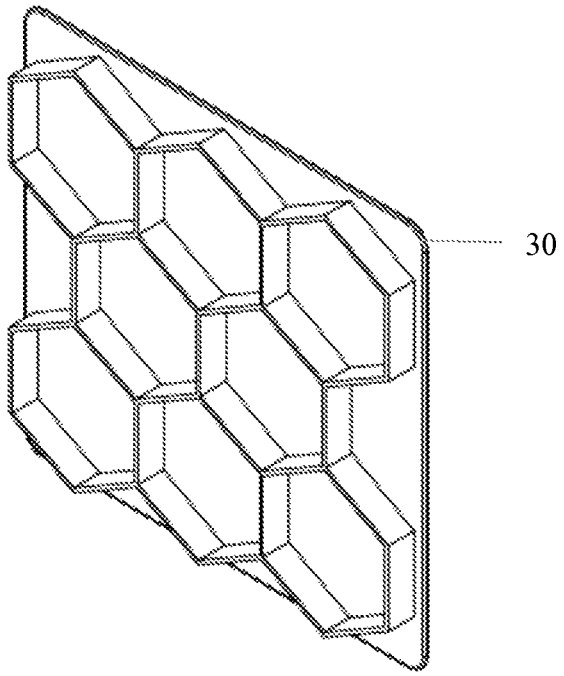
FIG. 3 is a perspective view of the lid of FIG. 1.

FIGS. 1 and 3 show a lid 20 of the container. The lid 20 has an array of walls 24 protruding from a bottom surface 28 of the lid 20 that form identical, contiguous, equilateral and equiangular hexagons. The lid 20 has a perimeter 30. The lid 20 and walls 24 are unitarily made from a flexible plastic.

Figure 2:
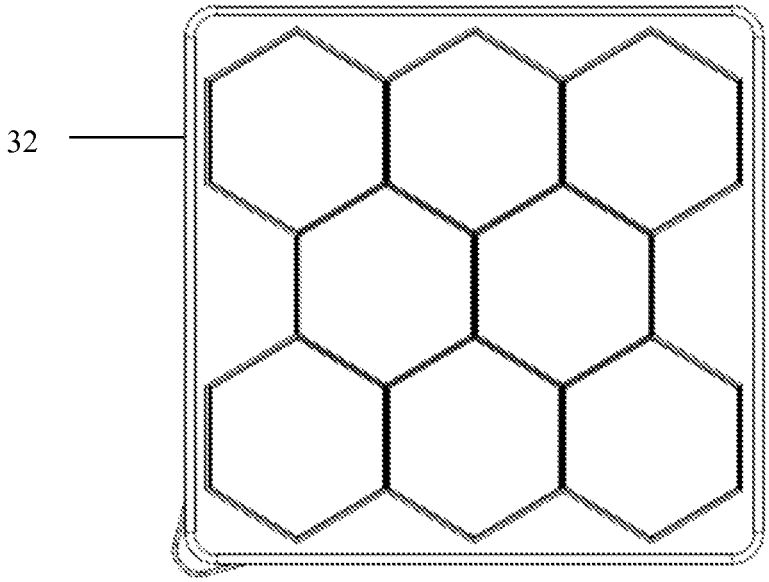
FIG. 2 is a top view of a tray of the food storage container having a set of ridges on a top surface of a recess thereof.
Figure 4:
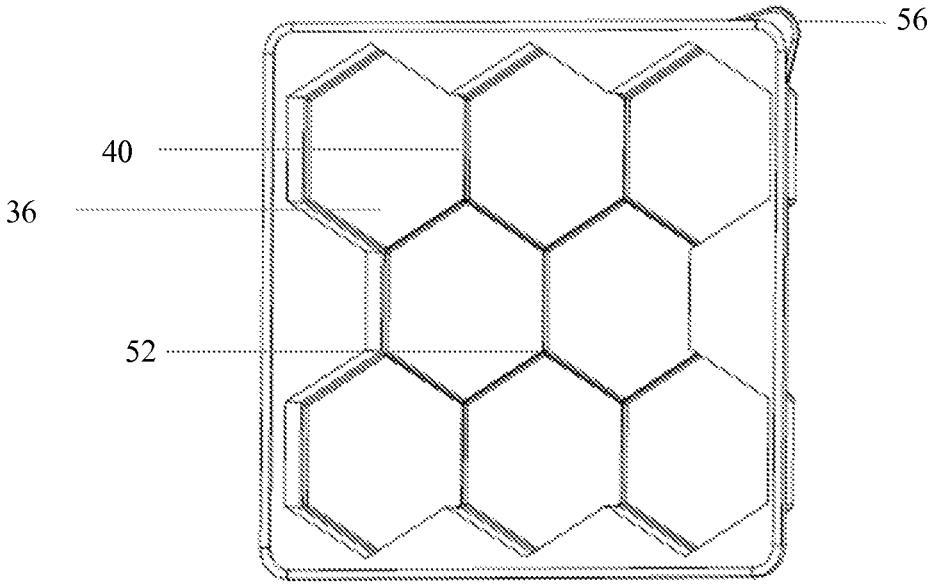
FIG. 4 is a perspective view of the tray of FIG. 2.
Figure 5:
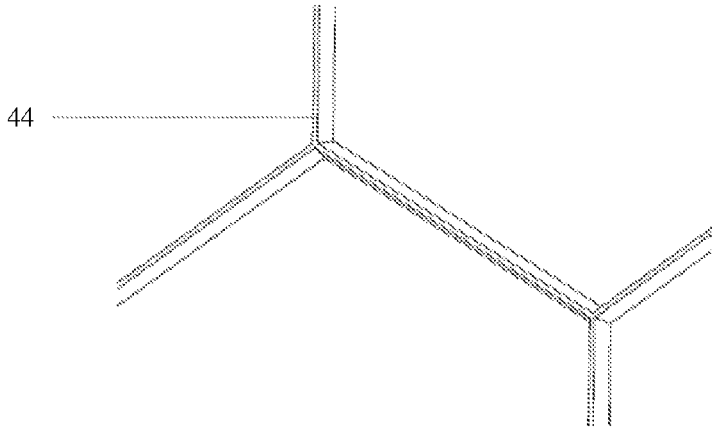
FIG. 5 is a perspective view of ridges along a top surface of the tray of FIG. 2.

FIGS. 2, 4, and 5 show a tray 32 of the container. The tray 32 includes a recess 36 that is dimensioned to tightly/snugly receive the walls 24 of the lid 20. An array of ridges 40 corresponding to the array of walls 24 of the lid 20 protrude from a top surface inside the recess 36 of the tray 32. The ridges 40 are sufficiently rigid to resist bending and deformation, and have tapered edges 44 as shown in FIG. 5.

A sealing mechanism for sealing the lid 20 and the tray 32 about their perimeters is provided by the tray 32 in the form of an overlapping lip 46. The overlapping lip 46 defines a grooved recess dimensioned to receive the perimeter 30 of the lid 20 snugly.

Like the lid 20, the tray 32 and ridges 40 are unitarily made from a flexible plastic.

Now, use of the container will be described with reference to FIGS. 1 to 6. In order to portion and store soft food material using the container, soft food material is spread generally atop of the tray 32 inside the recess 36. The lid 20 is then placed atop of the tray 32 so that the walls 24 slide into the recess 36. As the lid 20 is mated with the tray 32, the soft food material is shaped by the design of hexagonally shaped compartments 48 defined by the lid 20 and its walls 24, and the tray 32 and its ridges 40. The tapered edges 44 on the ridges 40 of the tray 32 provide a cutting action during the mating of the lid 20, and the tray 32. The walls 24 push the soft food material against the tapered edges 44 and acts to separate the soft food material into the compartments 48.

Pushing of the lid 20 into the tray 32 causes bottom surfaces of the walls 24 to contact with the ridges 40 to seal each compartment 48.

Figure 6:
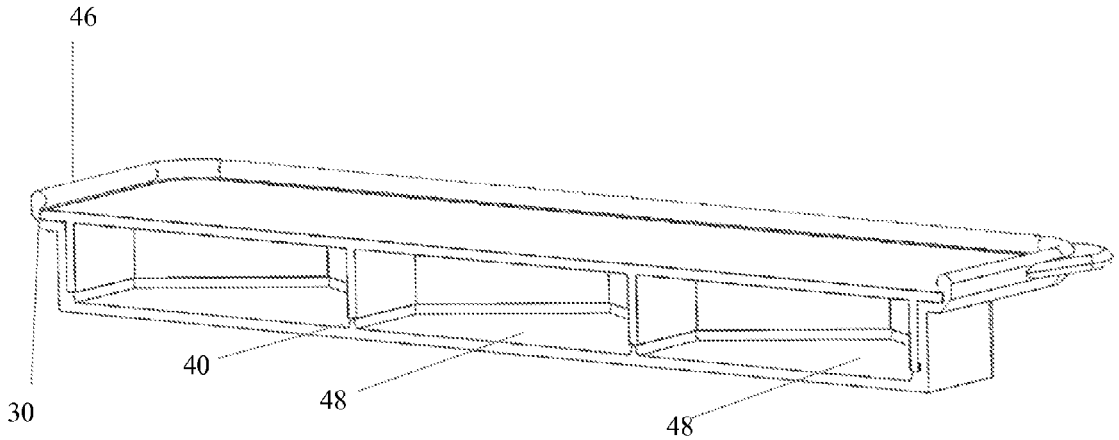
FIG. 6 is a perspective cutaway view of the cross-section of the lid of FIG. 1 and tray of FIG. 2 when mated, showing contact between bottom surfaces of the walls of the tray and top surfaces of the ridges.

Further, as the perimeter 30 of the lid 20 is pushed down, it slips into the grooved recess of the tray 32 defined by the overlapping lip 46. The overlapping lip 46 and the grooved recess of the tray 32 are dimensioned to provide a second seal between the lid 20 and the tray 32 when the perimeter 30 of the lid 20 is received. This is shown in FIG. 6. The overlapping lip 46 holds the lid 20 against the tray 32 so that the bottom surfaces of the walls 24 remain in sealing contact with the top surfaces of the ridges 40.

These two seals (that is, the ones between the walls 24 and the ridges 40 for each compartment 48 and the one about the perimeters of the lid 20 and the tray 32), serve to protect soft food material stored in the freezer from freezer burn. Even if the seal about the perimeter of the lid 20 and the tray 32 is broken, the seals for each compartment 48 generally remain intact. Each compartment 48 is completely self-enclosed, so that each food portion is doubly protected from freezer burn.

The hexagon shaped compartments 48 defined by the lid 20 and the tray 32 are identical, equilateral and equiangular, which enables equally sized shaping of soft food items.

As previously noted, the container lid 20 and tray 32 are entirely made of a malleable plastic that is soft and elastic throughout, including the walls 24. This enables easy separation of the soft food material from the tray 32 and the lid 20 after freezing the food. The plastic is soft enough to be very flexible, even at freezer temperatures. The geometry of the walls 24 in the hexagonal array make them rigid at each vertex 52. Despite being made of a flexible plastic, these rigid vertices 52 make it possible for the tapered ribs 40 of the tray 32 mating with the corresponding walls 24 of the lid 20 to cut through denser foods such as ground beef.

Once filled with food, the sealed container can be placed in a freezer. When the food portions are fully frozen, the container may easily be opened using a pull tab 56 at the corner of the tray 32. The soft plastic material flexes to allow easy removal of food portions, fresh or frozen. By peeling apart the lid 20 and the bottom tray 4 to partially separate them, as many pieces as required may be removed from the container without fully opening it. If the container is not fully opened, at least some of the compartments 48 opposite to the side where the container is being opened can remain sealed, thereby preventing exposure to ambient air of the undispensed food within and minimizing freezer burn. These remaining food portions may be returned to the freezer, each sealed, stored, and protected within their individual storage compartments 48.

The resulting hexagonally shaped food portions may then be transferred to be cooked, typically forming a rounded shape when heated, as in the case of cookies or ground meats.

While the compartments defined by the walls, ridges, and the recess in the above embodiment are described as being hexagonal, those skilled in the art will appreciate that compartments of other shapes can be used. For example, triangular or rectangular compartments can be employed in some cases. Adjustment of the thickness of the walls or the rigidity of the material may be desired to accommodate for the inherent differences in structural strength.

Other types of sealing mechanisms for retaining the lid in sealed relationship with the tray can be employed. For example, hinged clips or a rigid or flexible clamp can be used.

One or both of the lid and the tray can be constructed from other materials. While it may be preferred that the materials be flexible, it can be desirable in some cases to construct the lid and/or tray so that they are articulated; that is, they have flexible or hinged portions.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A container comprising:

a lid having a contiguous array of walls extending therefrom; and a tray having a recess for receiving soft food material, the recess sized to receive the array of walls of the lid, the tray having an array of ridges corresponding to the array of walls of the lid, a top surface of the ridges of the tray contacting a bottom surface of the walls of the lid when mated to form sealed compartments; and a sealing mechanism along a perimeter of at least one of the lid and the tray sealing the lid and the tray along perimeters thereof, and restricting separation of the bottom surface of the walls of the lid from the top surface of the ridges of the tray when mated;

at least one of the lid and the tray being formed from a flexible material so that the lid and the tray can be partially separated to remove a food portion formed in one of the compartments without breaking all of the seals of the compartments.

2. The container of claim 1, wherein at least one of the walls and the ridges between the compartments are tapered to facilitate separation of soft food material into the compartments.

3. The container of claim 2, wherein the ridges between the compartments are tapered.

4. The container of claim 2, wherein both the ridges and the walls are tapered.

5. The container of claim 1, wherein both the lid and the tray are made of a flexible material.

6. The container of claim 1, wherein the compartments defined by the array of walls and the array of ridges are hexagonal.

7. The container of claim 1, wherein the array of walls of the lid fit tightly into the recess of the tray.

8. The container of claim 1, wherein the walls of the lid are sufficiently rigid to push through soft food material when the lid and the tray are being mated.

9. The container of claim 1, wherein the sealing mechanism comprises an overlapping lip along the perimeter of the tray for receiving and engaging the perimeter of the lid.

10. The container of claim 1, wherein the tray comprises a pull tab located at a corner thereof to facilitate partial separation of the tray from the lid.

11. The container of claim 2, wherein the compartments defined by the array of walls and the array of ridges are hexagonal.

12. The container of claim 2, wherein the sealing mechanism comprises an overlapping lip along the perimeter of the tray for receiving and engaging the perimeter of the lid.

13. A container for apportioning and freezing soft food material, comprising:

a lid having walls extending from an undersurface thereof; and a tray having a recess for receiving soft food material and comprising ridges corresponding to the walls of the lid, the recess sized to snugly receive the walls of the lid, a bottom surface of the walls of the lid contacting a top surface of the ridges of the tray when mated to form sealed compartments; and a sealing mechanism along a perimeter of at least one of the lid and the tray sealing the lid and the tray along perimeters thereof, and restricting separation of the bottom surface of the walls of the lid from the tray when mated;

at least one of the lid and the tray being formed from a flexible material so that the lid and the tray can be partially separated to remove a food portion formed in one of the compartments without breaking all of the seals of the compartments.

14. The container of claim 13, wherein at least one of the walls and the ridges between the compartments are tapered to facilitate separation of soft food material into the compartments.

15. The container of claim 14, wherein the ridges between the compartments are tapered.

16. The container of claim 14, wherein both the ridges and the walls are tapered.

17. The container of claim 13, wherein both the lid and the tray are made of a flexible material.

18. The container of claim 13, wherein the compartments defined by the array of walls and the array of ridges are hexagonal.

19. The container of claim 13, wherein the sealing mechanism comprises an overlapping lip along the perimeter of the tray for receiving and engaging the perimeter of the lid.

* * * * *